US006910472B2

(12) United States Patent
Mizek et al.

(10) Patent No.: US 6,910,472 B2
(45) Date of Patent: Jun. 28, 2005

(54) ARCHERY BOW VIBRATION DAMPENER

(75) Inventors: Robert S. Mizek, Downers Grove, IL (US); Frank A. Harwath, Downers Grove, IL (US); Miroslav A. Simo, Riverside, IL (US)

(73) Assignee: New Archery Products Corp., Forest Park, IL (US)

( * ) Notice: Subject to any disclaimer, the term of this patent is extended or adjusted under 35 U.S.C. 154(b) by 0 days.

(21) Appl. No.: 10/771,086

(22) Filed: Feb. 3, 2004

(65) Prior Publication Data

US 2004/0154601 A1 Aug. 12, 2004

Related U.S. Application Data

(63) Continuation of application No. 10/035,041, filed on Dec. 27, 2001, now Pat. No. 6,684,874.

(51) Int. Cl.[7] ..... F41B 5/20
(52) U.S. Cl. ..... 124/89
(58) Field of Search ..... 124/89; 188/378; 267/136, 137

(56) References Cited

U.S. PATENT DOCUMENTS

| | | | |
|---|---|---|---|
| 3,258,000 | A | 6/1966 | Kolpacki |
| 3,412,725 | A | 11/1968 | Hoyt, Jr. |
| 3,525,322 | A | 8/1970 | Lee |
| 3,695,248 | A | 10/1972 | Izuta |
| 4,628,892 | A | 12/1986 | Windedahl et al. |
| 4,671,249 | A | 6/1987 | Troncoso |
| 4,811,947 | A | 3/1989 | Takatsuka et al. |
| 4,936,283 | A | 6/1990 | Izuta |
| 4,936,586 | A | 6/1990 | Van Raemdonck |
| 5,094,453 | A | 3/1992 | Douglas et al. |
| 5,314,180 | A | 5/1994 | Yamagishi et al. |
| 5,341,792 | A | 8/1994 | Pucillo |
| 5,362,046 | A | 11/1994 | Sims |
| 5,421,574 | A | 6/1995 | Yamagishi et al. |
| 5,772,541 | A | 6/1998 | Buiatti |
| 6,298,842 | B1 | 10/2001 | Sims |
| 6,526,957 | B1 | 3/2003 | Leven |

OTHER PUBLICATIONS

Sims Vibration Laboratory; *Limb Saver*, Bowhunter, 53–54, Oct./Nov. 2001.

"*The Bows that Take The Trophies*", York Archery, Feb. 11, 1991.

*Primary Examiner*—John A. Ricci
(74) *Attorney, Agent, or Firm*—Pauley Petersen & Erickson

(57) ABSTRACT

A device for reducing vibration and shock in an archery bow includes a base and an integral body formed of a flexible material. The body includes a non-uniform cross-section as the body extends away from the base and terminates in a peripheral mass positioned on a distal portion of the body opposite the base. As a result of such an arrangement, including the alternative of positioning two devices in axial alignment on an archery bow limb, vibration and shock following discharge of an arrow are greatly reduced in the archery bow.

17 Claims, 6 Drawing Sheets

ARCHERY BOW VIBRATION DAMPENER

This U.S. patent application is a Continuation patent application of U.S. patent application having Ser. No. 10/035,041, filed on 27 Dec. 2001, now U.S. Pat No. 6,684,874.

BACKGROUND OF THE INVENTION

1. Field of the Invention

This invention relates to a device for dampening vibration and reducing shock in an archery bow.

2. Description of Related Art

Archery bows typically absorb a great deal of shock and vibration upon release of an arrow. This shock and vibration can cause problems in the field when excess noise is created.

The primary mode of movement of a bow limb is normal to the limb surface. After the arrow is launched, the bow limbs snap back and encounter the greatest acceleration of the release process thus resulting in a shock. Often, vibration dampeners vibrate in a symmetric manner, in phase with the bow limb movements and therefore increase shock. This is because: (1) adding dead weight to a bow limb increases adds energy to the rebound of the bow limb and thus the added weight of the dampener on the bow limb increases shock; and (2) when the dampener moves in phase with the bow limb, the mass of the dampener is reactive thus increasing the magnitude of the shock.

There exists an apparent need for an effective device for dampening vibration and reducing shock specifically in an archery bow, and generally in any other apparatus which includes an excited surface to which energy is imparted.

SUMMARY OF THE INVENTION

One object of this invention is to provide a device that dampens vibration and reduces shock imparted to an archery bow upon release of an arrow.

Another object of this invention is to provide a device for dampening vibration and reducing shock that includes a peripherally mounted mass at a distal end.

The above and other objects of this invention are accomplished with a device that is preferably attached to both bow limbs of an archery bow to reduce vibration and shock imparted to the archery bow when an arrow is released. The device preferably includes a base and a body integrally formed of a flexible material. The base is formed to provide an adequate attachment surface to the archery bow and integrated with a body having a non-uniform cross-section as the body extends away from the base. Preferably, the non-uniform cross-section tapers in a continuously decreasing cross-sectional area as the body approaches the distal end.

A peripheral mass is preferably positioned on a portion of the body opposite the base. The peripheral mass preferably comprises perimeter weighting to react out of phase with the bow limb following discharge of arrow. The peripheral mass may include a thickened or increased cross-sectional area for obtaining the necessary perimeter weighting. The peripheral mass may include one or more flanges or tabs positioned at a distal end of the body.

The device according to this invention may be applied to the archery bow in a system for reducing vibration and shock. According to this system, two devices are positioned in general axial alignment on either side of a mount that is positioned on each bow limb of the archery bow. The resulting system therefore includes a mount and two devices, one device on a front of the bow limb and one device on a back of the bow limb.

Although described in the context of archery bows, the device according to this invention may be applicable generally to any other apparatus that includes an excited surface to which energy is imparted. Examples of such an apparatus include: household appliances such as dishwashers and washing machines, specifically doors and other panels of such household appliances; vehicles, including automobiles and aircraft; engines and motors; and/or any other apparatus wherein vibration and/or shock provide particular detriments to the safe, efficient and/or smooth operation of such apparatus.

BRIEF DESCRIPTION OF THE DRAWINGS

The technical features of this invention are apparent when the specification is read in view of the drawings, wherein.

DETAILED DESCRIPTION OF PREFERRED EMBODIMENTS

Figure 16:
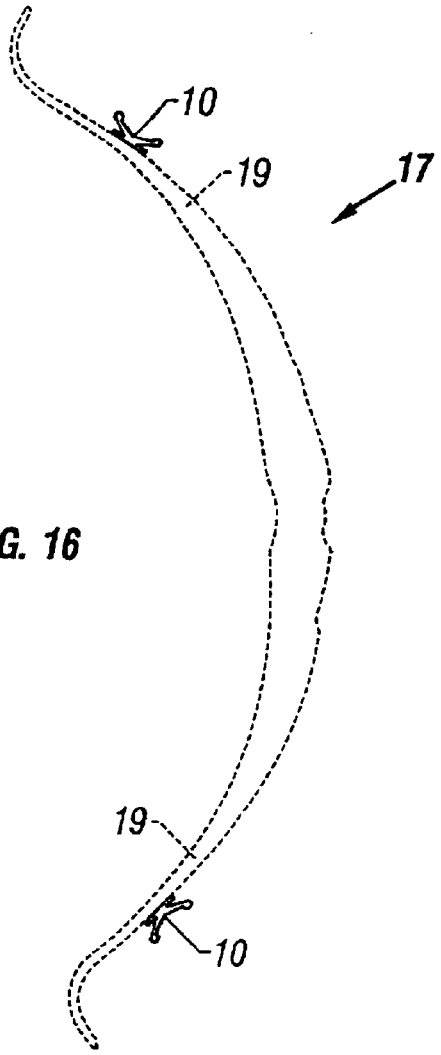
FIG. 16 is a side view of an archery bow having a device for dampening vibration and reducing shock according to one preferred embodiment of this invention.
Figure 17:
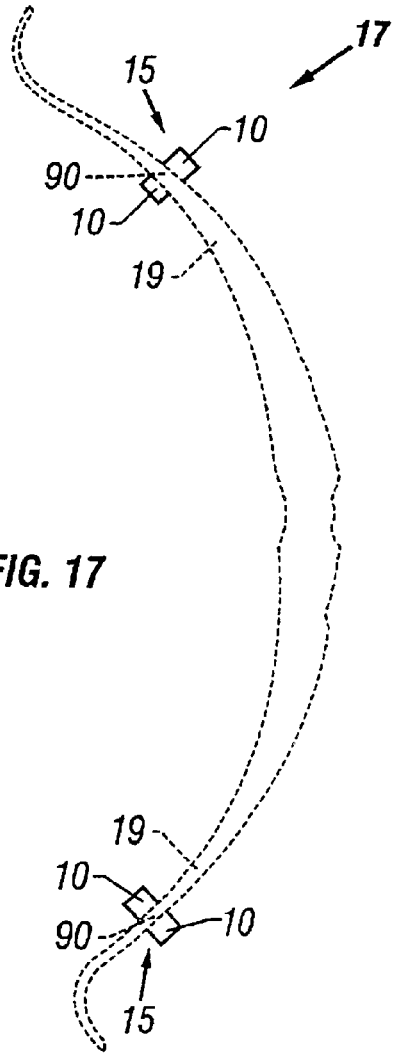
FIG. 17 is a side view of an archery bow having a system for dampening vibration and reducing shock according to one preferred embodiment of this invention.

FIGS. 1–12 show device 10 for reducing vibration and shock in an archery bow according to several preferred embodiments of this invention. As shown in FIG. 16, such devices 10 are preferably attached to bow limbs 19 on archery bow 17 to reduce vibration and shock imparted to archery bow 17 when an arrow is released.

Device 10 preferably includes base 20 and body 40 integrally formed of a flexible material. Appropriate materials include butyl rubber or other suitable elastomer having similar properties including a proper balance of elasticity, rigidity and durability.

Figure 1:
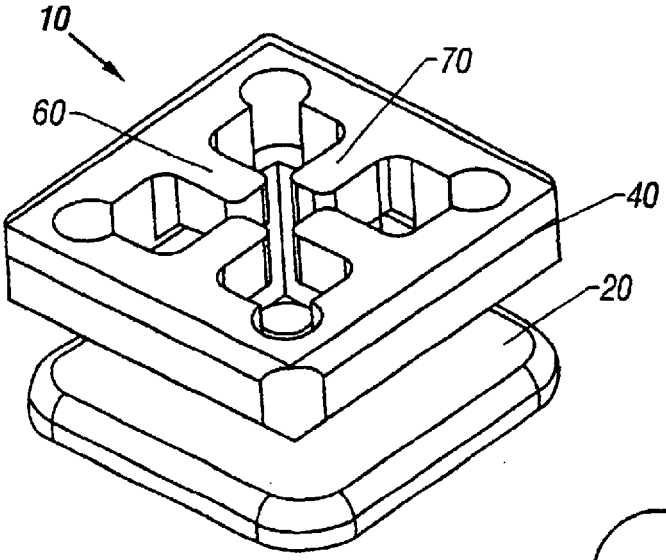
FIG. 1 is a perspective view of a device for dampening vibration and reducing shock according to one preferred embodiment of this invention.
Figure 2:
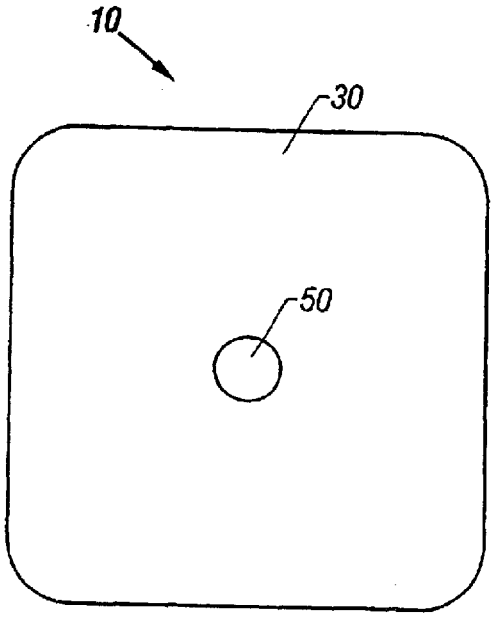
FIG. 2 is a bottom view of the device shown in FIG. 1.
Figure 3:
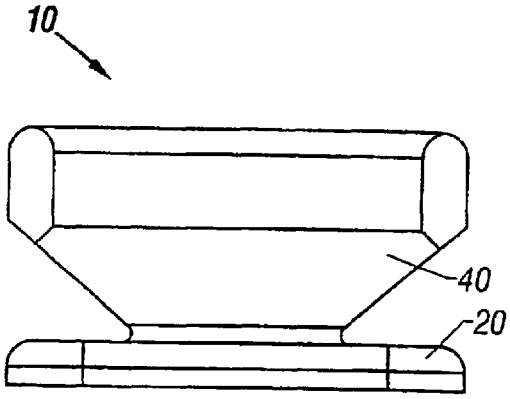
FIG. 3 is a side view of the device shown in FIG. 1.
Figure 5:
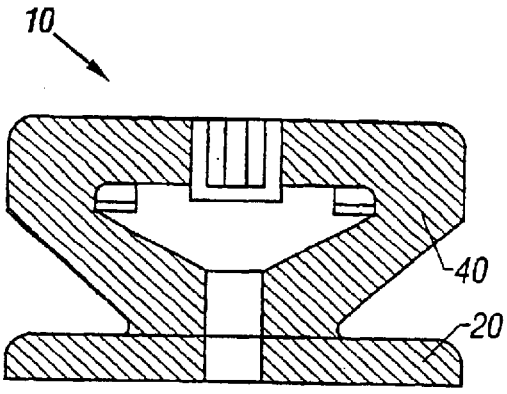
FIG. 5 is a sectional side view of the device shown in FIG. 1 taken along section 5—5 of FIG. 4.
Figure 4:
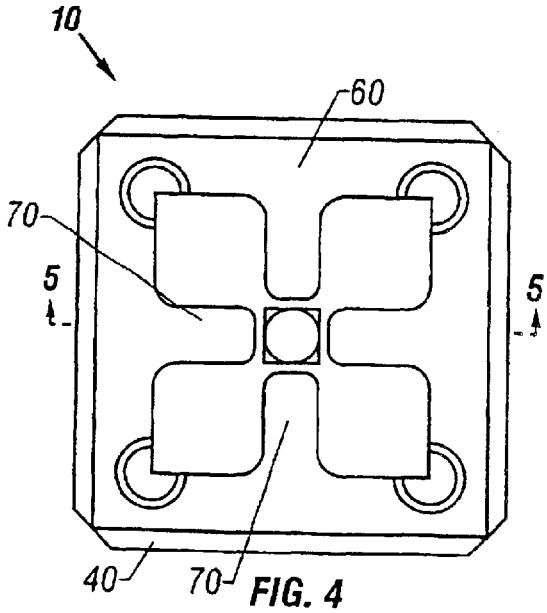
FIG. 4 is a top view of the device shown in FIG. 1.
Figure 6:
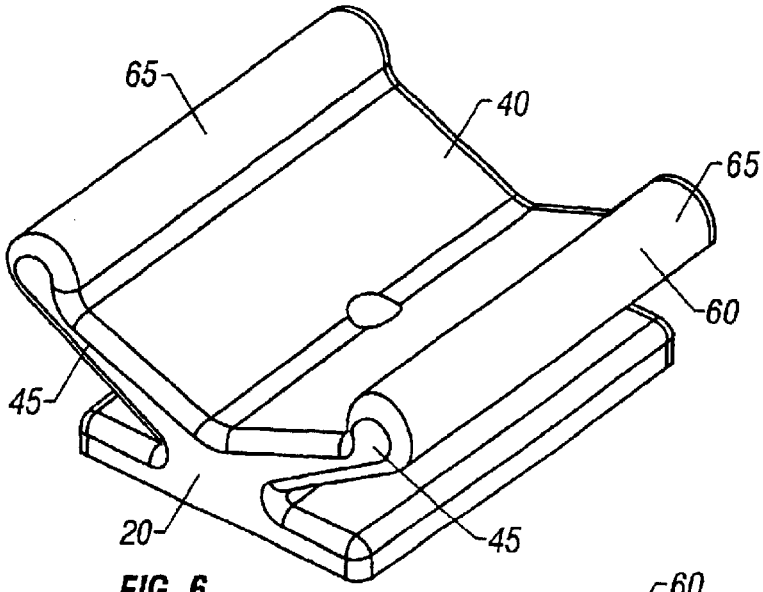
FIG. 6 is a perspective view of a device for dampening vibration and reducing shock according to one preferred embodiment of this invention.
Figure 7:
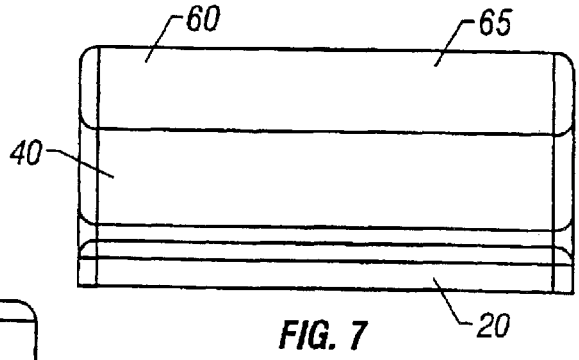
FIG. 7 is a side view of the device shown in FIG. 6.
Figure 8:
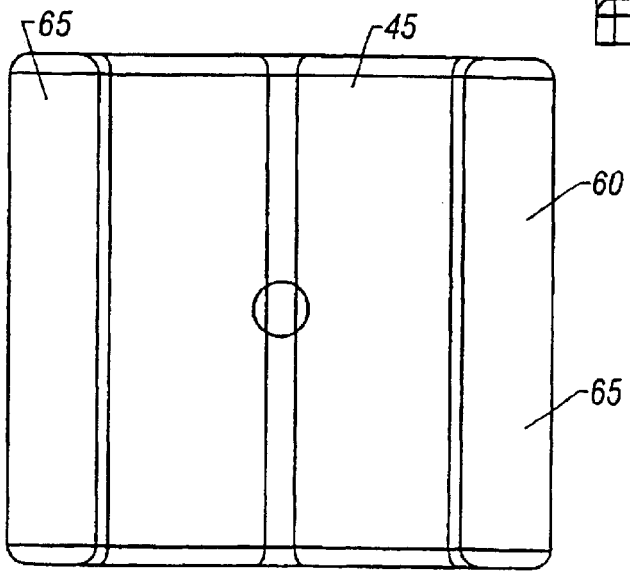
FIG. 8 is a top view of the device shown in FIG. 6.
Figure 9:
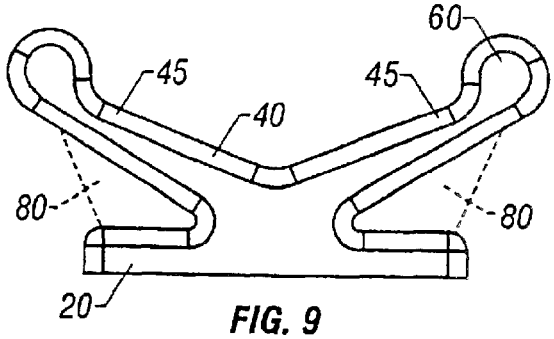
FIG. 9 is a front view of a device similar to the device shown in FIG. 6.
Figure 10:
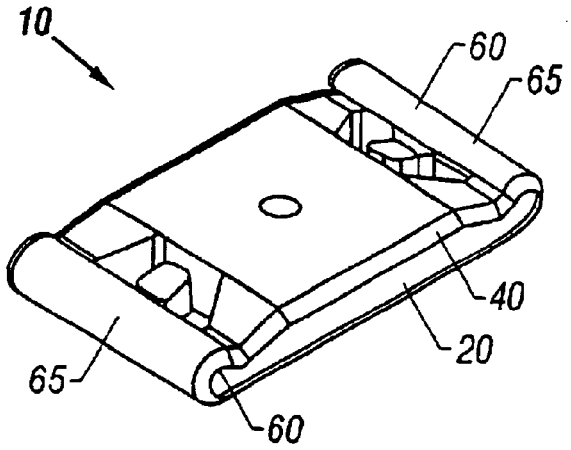
FIG. 10 is a perspective view of a device for dampening vibration and reducing shock according to one preferred embodiment of this invention.
Figure 11:
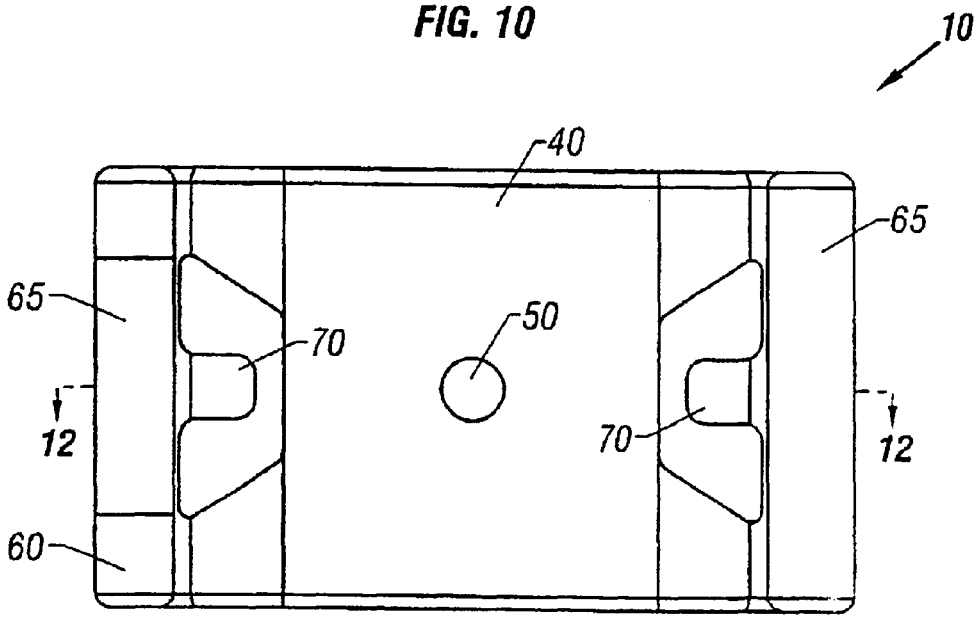
FIG. 11 is a top view of the device shown in FIG. 10.
Figure 12:
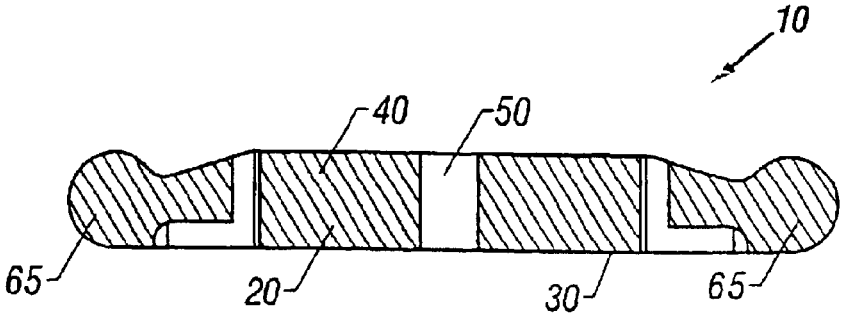
FIG. 12 is a section side view of the device shown in FIG. 10 taken along section 12—12 of FIG. 11.

Base 20, such as shown in FIG. 2, is preferably generally flat across a bottom surface 30 and provides an adequate footprint to attach with respect to archery bow 17. According to one preferred embodiment of this invention, base 20 is attached directly to archery bow 17 using adhesive, tape or other suitable manner of attaching an elastomer to a composite archery bow limb 19.

Body 40 is integrally formed with base 20, preferably during a molding process. However, base 20 and body 40 may be integrally molded, insert molded, overmolded with respect to each other or otherwise integrated to comprise a unitary device 10. Body 40 includes a non-uniform cross-section as body 40 approaches a distal end, specifically, the cross-section of body 40 changes as body 40 extends away from base 20, i.e. across a longitudinal length of body 40. According to one preferred embodiment of this invention, the non-uniform cross-section tapers in a continuously decreasing cross-sectional area as body 40 extends away from base 20. According to a preferred embodiment of this invention shown in FIGS. 1–5, body 40 and base 20 have footprints of generally the same dimensions.

FIGS. 1–5 show device 10 wherein body 40 comprises a tapered, inverted pyramid shape having a generally hollow center. FIGS. 6–9 show device 10 wherein body 40 comprises a tapered "V" shaped profile. According to one preferred embodiment of this invention, each arm 45 of the "V" shaped profile includes a tapered cross-section that reduces in cross-sectional area as it approaches a distal end of body 40.

Peripheral mass 60 is preferably positioned on a portion of body 40 opposite base 20. Peripheral mass 60 preferably comprises perimeter weighting along body 40. Perimeter weighting, when properly placed on or within device 10, assists in reducing shock. Perimeter weights, or more accurately masses such as peripheral mass 60, are preferably integrally molded with body 40 and base 20 or may comprise one or more separate components. Peripheral mass 60 preferably reacts with bow limb 19 following discharge of arrow. As a result of a combination of a non-uniform cross-section of body 40 and peripheral mass 60, the shock imparted to archery bow 17 during arrow launch is greatly reduced.

As discussed above, body 40 preferably has a broader cross-section toward base 20 and a narrower cross-section toward peripheral mass 60. Peripheral mass 60 may include a thickened or increased cross-sectional area for obtaining the necessary perimeter weighting. For example, peripheral mass 60 may include two or more flanges 65 extending laterally across body 40.

According to a preferred embodiment of this invention shown in FIGS. 1–5, peripheral mass 60 may include one or more tabs 70 positioned in generally parallel alignment with a bottom surface 30 of base 20. Tabs 70 are preferably positioned to vibrate out of phase with bow limb 19 and also out of phase with the remainder of body 40. Preferably tabs 70 extend over a hollow area of body 40 to permit free motion of tab 70 relative to body 40.

According to another preferred embodiment of this invention, one or more ribs 80 are positioned between peripheral mass 60 and base 20. Ribs 80, such as shown in hidden lines in FIG. 9, may be positioned to strengthen device 10 as a unit but still permit free vibration of body 40 and peripheral mass 60.

As shown variously in FIGS. 1–12, device 10 may further comprise through hole 50 extending through a center of body 40. Through hole 50 both encourages vibration of body 40 and also provides an attachment point for hardware to connect device 10 relative to archery bow 17.

As shown in FIGS. 13–15 and 17, device 10 may be applied to archery bow 17 in a system 15 for reducing vibration and shock. According to this system, mount 90 is positioned on limb 19 of archery bow 17. Mount 90 may be adhered or integrally formed with a conventional archery bow or anchored or otherwise positioned in the split of a split limb archery bow.

Figure 13:
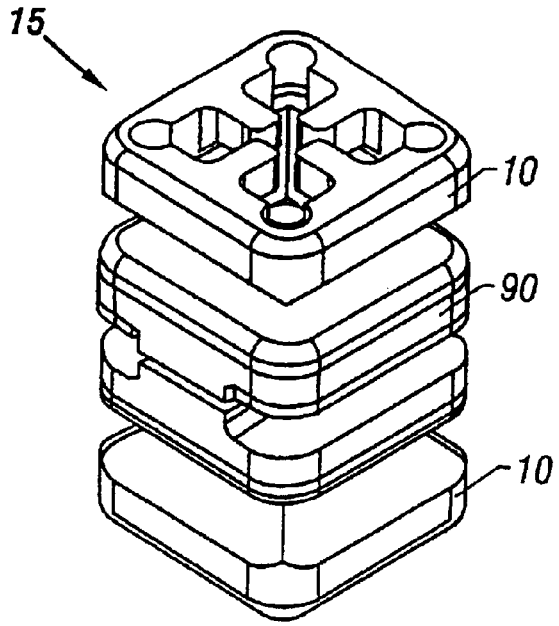
FIG. 13 is a perspective view of an assembly for dampening vibration and reducing shock according to one preferred embodiment of this invention.
Figure 14:
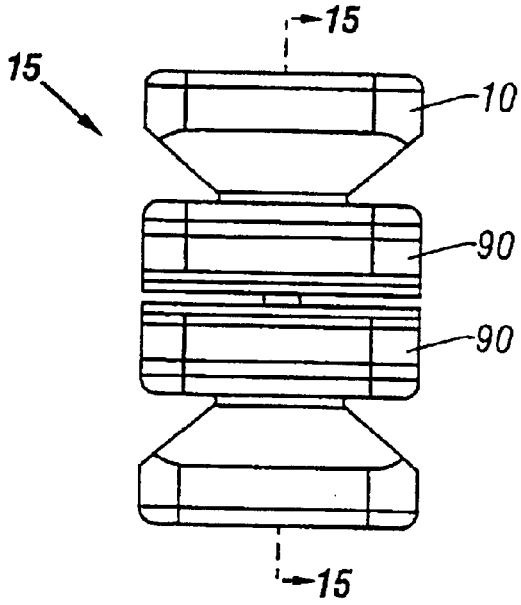
FIG. 14 is a side view of the assembly shown in FIG. 13.
Figure 15:
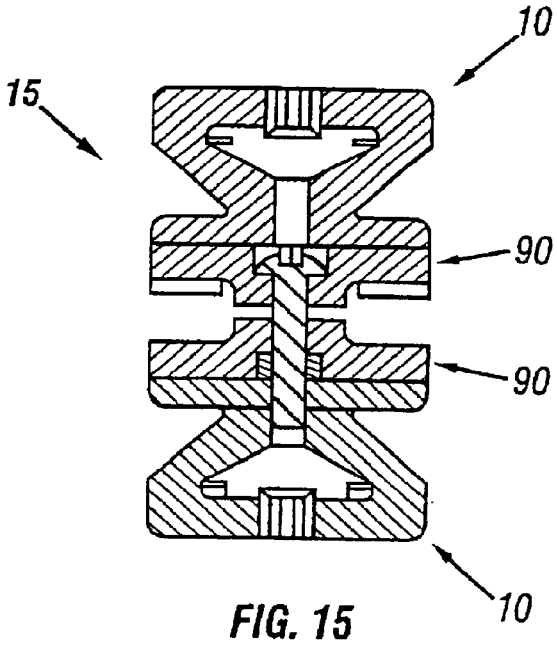
FIG. 15 is a sectional side view of the assembly shown in FIG. 13 taken along section 15—15 of FIG. 14.

Device 10, such as various embodiments described above, is then positioned on either side of mount 90 and connected to mount 90 so that device 10 on a top side of mount 90 is axially aligned with device 10 on a bottom side of mount 90. The resulting system 15 therefore includes mount 90 and two devices 10, one device 10 on a front of bow limb 19 and one device 10 on a back of bow limb 19, each device 10 in axial alignment with the other. As shown in FIGS. 13–15, hardware may be used to connect devices 10 to mount 90 through through hole 50 positioned through each device 10.

Figure 18:
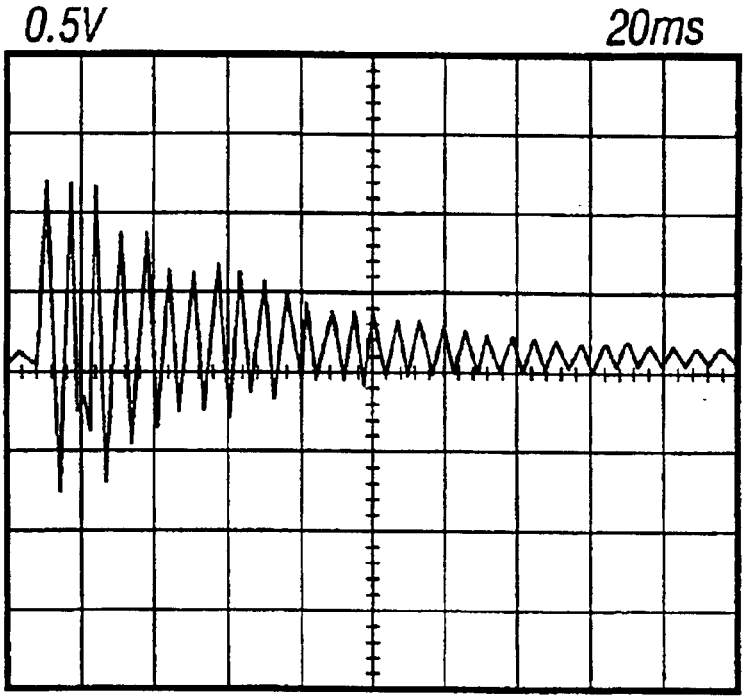
FIG. 18 is a chart showing vibration and shock imparted to a standard archery bow.
Figure 19:
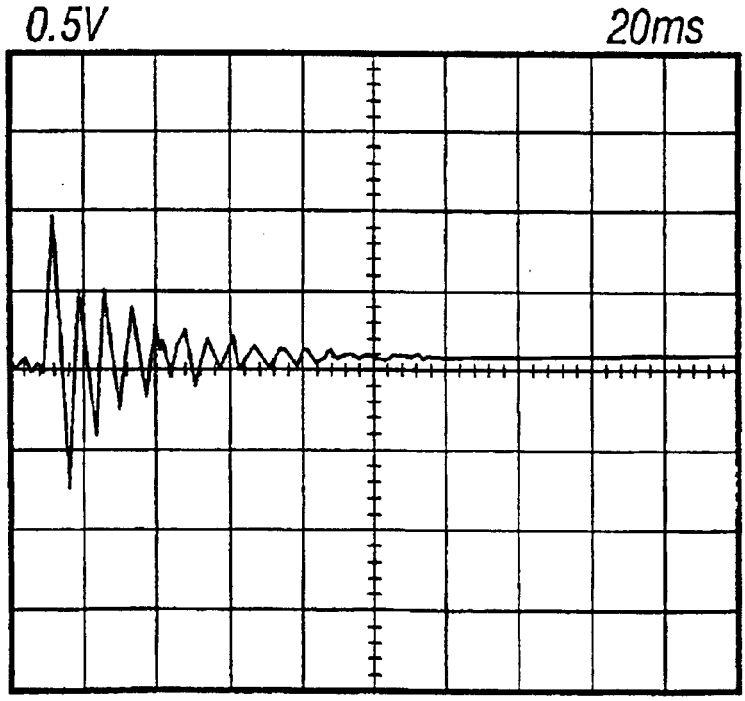
FIG. 19 is a chart showing vibration and shock imparted to a standard archery bow equipped with a device for dampening vibration and reducing shock according to one preferred embodiment of this invention.

FIG. 18 shows vibration over time in a typical archery bow following release of an arrow. FIG. 19 shows vibration over time in the same archery bow having system 15 mounted with respect to each bow limb. As evident, the initial vibration (measured displacement) which translates to shock is greatly reduced using system 15 according to this invention. In addition, vibration over time is greatly reduced when using system 15 according to this invention.

While in the foregoing specification this invention has been described in relation to certain preferred embodiments thereof, and many details have been set forth for purpose of illustration, it will be apparent to those skilled in the art that the invention is susceptible to additional embodiments and that certain of the details described can be varied considerably without departing from the basic principles of the invention.

We claim:

1. A device for reducing vibration and shock in an archery bow, the device comprising:

a base formed of a flexible material;

a body integrated with the base, wherein the body comprises a non-uniform cross-section as the body extends away from the base; and a peripheral mass positioned on a portion of the body opposite the base, wherein the peripheral mass comprises a pair of flanges extending laterally across the body.

2. The device of claim 1 wherein the body has a cross-section having a greater area toward the base and a cross-section having a smaller area toward the peripheral mass.

3. The device of claim 1 further comprising: one or more ribs positioned between the peripheral mass and the base.

4. The device of claim 1 wherein the body comprises a tapered "V" shaped profile.

5. A device for reducing vibration and shock in an archery bow, the device comprising:

a base formed of a flexible material;

a body integrated with the base;

a peripheral mass positioned on a portion of the body opposite the base, wherein the peripheral mass comprises a pair of flanges extending laterally across the body;

a mount positioned on a limb of the archery bow; and the base positioned on a side of the mount and connected to the mount so that the device may be axially aligned with a second device on an opposite side of the mount.

6. The device of claim 5 further comprising:

a through hole positioned through the base; and mounting hardware passing through the base to anchor the device with respect to the archery bow.

7. A device for reducing vibration and shock in an archery bow, the device comprising:

a base formed of a flexible material;

a body integrated with the base;

a peripheral mass positioned on a portion of the body opposite the base, wherein the peripheral mass comprises a pair of flanges extending laterally across the body; and a through hole extending through a center of the body.

8. The device of claim 7 wherein the body comprises a non-uniform cross-section as the body extends away from the base.

9. The device of claim 8 wherein the non-uniform cross-section comprises a continuously decreasing area as the body extends away from the base.

10. The device of claim 7 wherein the body comprises a pair of outwardly extending arms, each arm terminating in a flange of the pair of flanges forming the peripheral mass.

11. A device for reducing vibration and shock in an archery bow, the device comprising:

a body having an integrally formed base; and a peripheral mass positioned at a distal end of the body resulting in an asymmetric vibration of the device when an arrow is discharged from the archery bow, wherein the peripheral mass comprises a pair of flanges extending laterally across the body, wherein the body comprises a pair of outwardly extending arms, each arm terminating in a flange of the pair of flanges forming the peripheral mass.

12. The device of claim 11 wherein the body extends away from the base in a cross-section having a decreasing area.

13. A device for reducing vibration and shock in an archery bow, the device comprising:

a body having an integral base, the body having a non-uniform cross-section across a longitudinal length of the body terminating at a peripheral mass positioned at a distal end of the body, wherein the peripheral mass comprises a pair of flanges extending laterally across the body.

14. The device of claim 13 wherein the body comprises a pair of outwardly extending arms, each arm terminating in a flange of the pair of flanges forming the peripheral mass.

15. The device of claim 13 wherein the body and the base are integrally molded to form a unitary, single-piece device.

16. The device of claim 13 in combination with:

a mount positioned on a limb of the archery bow; and the base positioned on a side of the mount and connected to the mount so that the device may be axially aligned with a second device on an opposite side of the mount.

17. The device of claim 16 further comprising:

a through hole positioned through the base; and mounting hardware passing through the base to anchor the device with respect to the archery bow.

* * * * *